US006234897B1

(12) United States Patent
Frohm et al.

(10) Patent No.: US 6,234,897 B1
(45) Date of Patent: May 22, 2001

(54) GAMING DEVICE WITH VARIABLE BONUS PAYOUT FEATURE

(75) Inventors: Erica A. Frohm, Evanston; Lawrence E. DeMar, Winnetka; Robert J. Wilson, Jr., Buffalo Grove, all of IL (US); Alfred Thomas, Las Vegas, NV (US)

(73) Assignee: WMS Gaming Inc., Chicago, IL (US)

( * ) Notice: Subject to any disclaimer, the term of this patent is extended or adjusted under 35 U.S.C. 154(b) by 0 days.

(21) Appl. No.: 09/382,922

(22) Filed: Aug. 25, 1999

Related U.S. Application Data

(63) Continuation-in-part of application No. 09/140,947, filed on Aug. 27, 1998, which is a continuation-in-part of application No. 08/835,840, filed on Apr. 23, 1997.

(51) Int. Cl.[7] ..... A63F 9/00; G07F 17/34

(52) U.S. Cl. ..... 463/20; 273/143 R

(58) Field of Search ..... 273/143 R, 138.1, 273/138.2; 463/20

(56) References Cited

U.S. PATENT DOCUMENTS

| | | |
|---|---|---|
| 3,281,149 | 10/1966 | Miller . |
| 4,095,795 | 6/1978 | Saxton et al. . |
| 4,306,768 | 12/1981 | Egging . |

(List continued on next page.)

FOREIGN PATENT DOCUMENTS

| | | |
|---|---|---|
| 37 00 861 | 7/1988 | (DE) . |
| 40 14 477 | 7/1991 | (DE) . |
| 0 142 371 | 5/1985 | (EP) . |

(List continued on next page.)

OTHER PUBLICATIONS

Brochure of Monopoly SWP Game; JPM Ltd., 4 pgs.; date unknown.
WMS' Big Money Advertisement Sheet; WMS Gaming Inc., 1 pg.; date unknown.
WMS' Piggy Bankin' Advertisement Sheet; WMS Gaming Inc., 1 pg.; date unknown.
WMS' Pirate's Thunder Advertisement Sheet; WMS Gaming Inc.; 1 pg.; date unknown.
Bally Circus Ad. excerpt from "Lemons, Cherries and Bell Fruit Gum"; Richard M. Bueschel; 3 pgs.; date unknown.
Bally Bingo Ad, excerpt from "Lemons, Cherries and Bell Fruit Gum"; Richard M. Bueschel; 1 pg.; date unknown.
Las Vegas Slot Machine Ad, excerpt from "Lemons, Cherries and Bell Fruit Gum"; Richard M. Bueschel; 1 pg.; date unknown.
Phantom Haus website publication; Williams Electronics Games, Inc.; 2 pgs.; date unknown.
Arabian Riches website publication; Silicon Gaming Inc.; 2 pgs.; date Jul. 17, 1998.
Buccaneer Gold website publication; Silicon Gaming Inc.; 2 pgs.; date Jul. 17, 1998.
Fort Knox website publication; Silicon Gaming Inc.; 2 pgs.; date Jul. 17, 1998.

(List continued on next page.)

*Primary Examiner*—Benjamin H. Layno
(74) *Attorney, Agent, or Firm*—Jenkens & Gilchrist

(57) ABSTRACT

A slot machine comprises a spinning reel display and a bonus game. The spinning reel display shows a plurality of symbols on each of a plurality of rotatable reels. The reels are rotated and stopped to place the symbols of each reel in visual association with a pay line. The pay line is associated with at least one of the symbols on each of the reels. The bonus game is triggered in response to start-bonus symbols from the respective stopped reels appearing in the spinning reel display. The bonus game having different expected values based on different arrangements of the start-bonus symbols in the spinning reel display.

33 Claims, 11 Drawing Sheets

U.S. PATENT DOCUMENTS

| | | |
|---|---|---|
| 4,335,809 | 6/1982 | Wain . |
| 4,448,419 | 5/1984 | Telnaes . |
| 4,508,345 | 4/1985 | Okada . |
| 4,624,459 | 11/1986 | Kaufman . |
| 4,721,307 | 1/1988 | Okada . |
| 4,763,256 | 8/1988 | DeMar . |
| 4,772,023 | 9/1988 | Okada . |
| 4,805,907 | 2/1989 | Hagiwara . |
| 4,871,171 | 10/1989 | Rivero . |
| 5,083,785 | 1/1992 | Okada . |
| 5,167,147 | 12/1992 | Hamano . |
| 5,205,555 | 4/1993 | Hamano . |
| 5,259,616 | 11/1993 | Bergmann . |
| 5,292,127 | 3/1994 | Kelly et al. . |
| 5,342,047 | 8/1994 | Heidel et al. . |
| 5,342,049 | 8/1994 | Wichinsky et al. . |
| 5,380,008 | 1/1995 | Mathis et al. . |
| 5,393,057 | 2/1995 | Marnell, II . |
| 5,401,024 | 3/1995 | Simunek . |
| 5,415,404 | 5/1995 | Joshi et al. . |
| 5,429,361 | 7/1995 | Raven et al. . |
| 5,449,173 | 9/1995 | Thomas et al. . |
| 5,456,465 | 10/1995 | Durham . |
| 5,456,466 | 10/1995 | Miles . |
| 5,542,669 | 8/1996 | Charron et al. . |
| 5,547,192 | 8/1996 | Ishibashi . |
| 5,624,119 | 4/1997 | Leake . |
| 5,647,798 | 7/1997 | Falciglia . |
| 5,664,781 | 9/1997 | Feola . |
| 5,697,843 | 12/1997 | Manship et al. . |
| 5,704,835 | 1/1998 | Dietz, II . |
| 5,722,891 | 3/1998 | Inoue . |
| 5,749,580 | 5/1998 | Lopez . |
| 5,779,545 | 7/1998 | Berg et al. . |
| 5,788,573 | 8/1998 | Baerlocher et al. . |
| 5,823,874 | 10/1998 | Adams . |
| 5,848,932 | 12/1998 | Adams . |
| 5,951,397 | 9/1999 | Dickinson . |

FOREIGN PATENT DOCUMENTS

| | | |
|---|---|---|
| 0 148 001 | 7/1985 | (EP) . |
| 0 333 338 | 9/1989 | (EP) . |
| 0 577 415 A2 | 1/1994 | (EP) . |
| 1 474 617 | 4/1966 | (FR) . |
| 1129607 | 10/1968 | (GB) . |
| 1 476 848 | 6/1977 | (GB) . |
| 1 591 623 | 6/1981 | (GB) . |
| 2 066 991 | 7/1981 | (GB) . |
| 2 072 395 | 9/1981 | (GB) . |
| 2 083 936 | 3/1982 | (GB) . |
| 2 084 371 | 4/1982 | (GB) . |
| 2 096 376 | 10/1982 | (GB) . |
| 2 097 160 | 10/1982 | (GB) . |
| 2 106 685 | 4/1983 | (GB) . |
| 2 117 952 | 10/1983 | (GB) . |
| 2 147 442 | 5/1985 | (GB) . |
| 2 147 773 | 5/1985 | (GB) . |
| 2 152 262 | 7/1985 | (GB) . |
| 2 153 572 | 8/1985 | (GB) . |
| 2 157 047 | 10/1985 | (GB) . |
| 2 165 385 | 4/1986 | (GB) . |
| 2 170 636 | 8/1986 | (GB) . |
| 2 180 087 | 3/1987 | (GB) . |
| 2 181 589 | 4/1987 | (GB) . |
| 2 183 882 | 6/1987 | (GB) . |
| 2 191 030 | 12/1987 | (GB) . |
| 2 197 974 | 6/1988 | (GB) . |
| 2 202 984 | 10/1988 | (GB) . |
| 2 204 436 | 11/1988 | (GB) . |
| 2 210 191 | 6/1989 | (GB) . |
| 2 222 712 | 3/1990 | (GB) . |
| 2 226 907 | 7/1990 | (GB) . |
| 2 229 565 | 9/1990 | (GB) . |
| 2 230 373 | 10/1990 | (GB) . |
| 2 233 806 | 1/1991 | (GB) . |
| 2 242 300 | 9/1991 | (GB) . |
| 2 253 154 | 9/1992 | (GB) . |
| 2 105 891 | 3/1993 | (GB) . |
| 2 262 642 | 6/1993 | (GB) . |
| 2 270 787 | 3/1994 | (GB) . |
| 2 273 384 | 8/1994 | (GB) . |
| 2 287 567 | 9/1995 | (GB) . |
| 2 297 857 | 8/1996 | (GB) . |
| 2 298 508 | 9/1996 | (GB) . |
| WO 8808179 | 10/1988 | (WO) . |
| WO 8912875 | 12/1989 | (WO) . |
| WO 9210818 | 6/1992 | (WO) . |
| WO 9401840 | 1/1994 | (WO) . |
| WO 9635491 | 11/1996 | (WO) . |

OTHER PUBLICATIONS

Lady of Fortune website publication; Silicon Gaming Inc.; 2 pgs.; date Jul. 17, 1998.
Riddle of the Sphinx website publication; Silicon Gaming Inc.; 2 pgs.; date Jul. 17, 1998.
Information Sheets for Kaleidoscope game; Williams Electronics Games, Inc.; 3 pgs.; date unknown.
Information Sheets for Double Wild & Loose Game; Williams Electronics Games, Inc.; 3 pgs.; date unknown.
Information Sheets for Wild Cherry (120 A) Game; International Game Technology.; 2 pgs.; date Nov. 7, 1994.
Information Sheets for Double Wild Cherry (195 A) Game; International Game Technology.; 3 pgs.; date Nov. 7, 1994.
Chapters 10, 11, 12; excerpts from "Lemons, Cherries and Bell–Fruit–Gum"; Richard M. Bueschel; 71 pgs.; 1995.
Advertisement, Club Vegas, Barcrest; 1 pg.; date unknown.
Advertisement, Viva Club Vegas!, Barcrest; 1 pg.; date unknown.
Advertisement, "Monopoly: Maygay There for the Taking"; 2 pgs.; date unknown.
Advertisement, "The Big Breakfast"; Channel Four Television Corporation; 2 pgs.; 1993.
Advertisement, "Midas Touch"; 2 pgs.; date unknown.
Advertisement, "Acropolis"; Automatic (Fruit) Designs, Ltd.; 2 pgs.; date unknown.
Advertisement, "Adders & Ladders"; Barcrest; 2 pgs.; date unknown.
Advertisement, "The Wild West"; Bell–Fruit Manufacturing; 2 pgs.; date unknown.
Advertisement, "Premier Club Manager"; Bell–Fruit Manufacturing; 2 pgs.; date unknown.
Advertisement, "Fortune Wheel"; Project Customer Services; 2 pgs.; date unknown.
Advertisement, "Road Hog"; Barcrest; 2 pgs.; date unknown.
Advertisement, "Viva! Six! Las Vegas"; Barcrest; 2 pgs.; date unknown.
Advertisement, "Golden Circle"; Delta Automaten; 1 pg.; date unknown.
Advertisement, "Club Double"; M–D–M Coin Sales Ltd.; 2 pgs.; date unknown.
Advertisement, "Treasure Island"; American Alpha, Inc.; 1 pg.; date unknown.
Advertisement, "Bonus Card"; Andries Robert Automatic s.p.r.l.; 1 pg.; date unknown.

Advertisement, "Super Square"; Maygay Machines Ltd.; 2 pgs.; date unknown.
Advertisement, "Lucky Bank"; 1 pg.; date unknown.
Advertisement, "Happy Clown"; Andries Robert Automatic s.p.r.; 1 pg.; date unknown.
Advertisement, "Jackpot Stampede"; WMS Gaming Inc.; 2 pgs.; date unknown.
Brochure, "Perfect Universal Slot Machines"; Universal Co., Ltd.; 16 pgs.; date unknown.
Advertisement, "Club Make a Million"; Bell–Fruit Manufacturing Co., Ltd.; 2 pgs.; date unknown.
Advertisement, "Instant Jackpots"; Bell–Fruit Manufacturing Co., Ltd.; 2 pgs.; date unknown.
Cover page, "Enter Disposable Gaming", *Euroslot. The International Coin–Operated Machine Journal*; 1 pg.; Apr., 1994.
Advertisement, Barcrest Limited; 1 pg.; date unknown.
Cover page, "Covers Your World", *Euroslot. The Currency of the Coin Machine Industry*; 1 pg.; date unknown.
Article, "Bangkok on the Brink"; *Euroslot. The International Coin–Operated Machine Journal*; 2 pgs.; Nov., 1993.
Article, "Scandinavia on the Brink of the EU melting pot"; *Euroslot. The International Coin–Operated Machine Journal*; 2 pgs.; Aug., 1994.
Advertisement, "Only Fools and Horses"; Bell–Fruit Manufacturing Co., Ltd.; 2 pgs.; date unknown.
Advertisement, "Main Attraction"; Bell–Fruit Manufacturing Co., Ltd., 2 pgs.; date unknown.
Brochure, "World Players"; Barcrest; 6 pgs.; date unknown.
Brochure, "JPM Presents Monopoly Deluxe"; JPM International Ltd.; 5 pgs.; date unknown.
Brochure, "The 50th Show"; Ate International; 2 pgs.; Jan., 1994.
Advertisement, "Colossus"; AFD.; 1 pg.; date unknown.
Advertisement, "Wheel of Fortune"; Project Creating Entertainment; 2 pgs.; date unknown.
Advertisement, "Lucky Horseshoes"; JPM Automatic Machines Ltd.; 2 pgs., date unknown.
Advertisement, "Lucky Jackpots"; JPM Automatic Machines Ltd., 2 pgs.; date unknown.
Advertisement, "Monopoly"; JPM Automatic Machines Ltd.; 2 pgs.; date unknown.
Press Release; "WMS Gaming on a *Winning Streak*™ With Its Newest Reel Spinning Slot Product," Oct. 7, 1997, 2 pgs.
Product Sheet; "Winning Streak," (1999), 1 pg.
Article; "Winning Streak," *Strictly Slots*, Feb. 1999, p. 45.
Photograph of "Jeopardy" Slot Machine, IGT, Las Vegas, Nevada, date unknown, 1 pg.
Internet Web Page; "International Game Technology Reports Earnings of $0.26 Per Share for the First Quarter of Fiscal 1998," IGT, Las Vegas, Nevada, Jan. 15, 1998, 1 pg.
Product Sheet; "Stroke of Luck," WMS Gaming Inc., Chicago, Illinois, 1998.

*Fig. 3*

| | | | | BASE GAME | |
|---|---|---|---|---|---|
| BASE GAME | | | | | |
| SYMBOLS | REEL 1 | REEL 2 | REEL 3 | | |
| WINSTREAK | 2 | 3 | 1 | | |
| WSBLANK | 4 | 6 | 2 | | |
| 3BAR | 4 | 1 | 1 | | |
| 2BAR | 3 | 2 | 2 | | |
| 1BAR | 2 | 4 | 6 | | |
| BLANKS | 7 | 5 | 9 | | |
| CHERRY | 0 | 1 | 1 | | |
| | 22 | 22 | 22 | | |

*Fig. 4*

| BASE GAME REELSTRIPS | | | |
|---|---|---|---|
| | REEL 1 | REEL 2 | REEL 3 |
| 1 | 2BAR | 2BAR | 1BAR |
| 2 | | | |
| 3 | 3BAR | 1BAR | 2BAR |
| 4 | | | |
| 5 | WINSTREAK | WINSTREAK | 1BAR |
| 6 | | | |
| 7 | 1BAR | 3BAR | 3BAR |
| 8 | | | |
| 9 | 3BAR | 1BAR | 1BAR |
| 10 | | | |
| 11 | 2BAR | WINSTREAK | WINSTREAK |
| 12 | | | |
| 13 | WINSTREAK | CHERRY | 1BAR |
| 14 | | | |
| 15 | 3BAR | 1BAR | CHERRY |
| 16 | | | |
| 17 | 1BAR | WINSTREAK | 1BAR |
| 18 | | | |
| 19 | 2BAR | 2BAR | 2BAR |
| 20 | | | |
| 21 | 3BAR | 1BAR | 1BAR |
| 22 | | | |

*Fig. 5*

| COMBINED GAME PAY SCHEDULE | | | | | |
|---|---|---|---|---|---|
| COMB | PAY | PROB | EV | PULLS | MAXCONT |
| 3WINSTREAK | 55.46652 | 0.000563 | 0.031255 | 1774.667 | 3.310713 |
| 3ANYSTREAK | 27.73326 | 0.014651 | 0.40631 | 68.25641 | 43.03927 |
| 3BARS | 50 | 0.000376 | 0.018783 | 2662 | 1.989617 |
| 2BARS | 20 | 0.001127 | 0.022539 | 887.3333 | 2.38754 |
| 1BARS | 10 | 0.004508 | 0.045079 | 221.8333 | 4.77508 |
| ANYBAR | 5 | 0.047239 | 0.236195 | 21.16899 | 25.01943 |
| 2CHERRY | 5 | 0.002066 | 0.010331 | 484 | 1.094289 |
| CHERRY | 2 | 0.086777 | 0.173554 | 11.52381 | 18.38406 |
| | | 0.157307 | 0.944045 | | |

Fig. 6

| BONUS GAME | | | | | | |
|---|---|---|---|---|---|---|
| SYMBOL | REEL 1 | REEL 2 | REEL 3 | | | |
| REDSEVEN | 1 | 1 | 1 | | | |
| BLUESEVEN | 1 | 1 | 1 | | | |
| 3BAR | 6 | 6 | 4 | | | |
| 2BAR | 4 | 4 | 5 | | | |
| 1BAR | 6 | 6 | 6 | | | |
| CHERRY | 4 | 4 | 5 | | | |
| | 22 | 22 | 22 | | | |
| | 10648 | | | | | |
| | | | | | | |
| BONUS GAME PAY SCHEDULE | | | | | | |
| COMB | PAY | PROB | EV | PULLS | | |
| REDSEVEN | 1500 | 9.39E-05 | 0.140872 | 10648 | | |
| BLUESEVEN | 500 | 9.39E-05 | 0.046957 | 10648 | | |
| ANYSEVEN | 100 | 0.000563 | 0.056349 | 1774.667 | | |
| 3BARS | 50 | 0.013524 | 0.676183 | 73.94444 | | |
| 2BARS | 20 | 0.007513 | 0.150263 | 133.1 | | |
| 1BAR | 10 | 0.020285 | 0.202855 | 49.2963 | | |
| 3CHERRIES | 10 | 0.007513 | 0.075131 | 133.1 | | |
| ANYBAR | 5 | 0.319309 | 1.596544 | 3.131765 | | |
| 2CHERRIES | 5 | 0.093163 | 0.465815 | 10.73387 | | |
| CHERRY | 2 | 0.382044 | 0.764087 | 2.617502 | | |
| | | 0.844102 | 4.175056 | | | |
| | | | | | | |

| | |
|---|---|
| BONUS GAME FEATURE | |
| S=EXPECTED # OF SPINS (WINNING SPINS + 1 LOSER TO END FEATURE) | 6.414458 |
| X=EXPECTED WIN PER SPIN | 4.175056 |
| C=EXPECTED WIN FROM FEATURE | 26.78072 |
| | |
| BONUS GAME TOTAL | |
| TOTAL FROM BONUS GAME SPINS | 26.78072 |
| TOTAL FROM 2ND CHANCE FEATURE | 0.952536 |
| | 27.73326 |

Fig. 9

| BASE GAME REELSTRIPS | | | |
|---|---|---|---|
| | REEL 1 | REEL 2 | REEL 3 |
| 1 | PMATCH | PMATCH | PMATCH |
| 2 | | | |
| 3 | 1BAR | 1BAR | CHERRY |
| 4 | | | |
| 5 | 2BAR | 2BAR | 1BAR |
| 6 | | | |
| 7 | 3BAR | PMATCH | 2BAR |
| 8 | | | |
| 9 | 1BAR | 1BAR | 3BAR |
| 10 | | | |
| 11 | PMATCH | 2BAR | 1BAR |
| 12 | | | |
| 13 | 1BAR | PMATCH | 2BAR |
| 14 | | | |
| 15 | 2BAR | 1BAR | 3BAR |
| 16 | | | |
| 17 | 3BAR | 2BAR | 1BAR |
| 18 | | | |
| 19 | 1BAR | PMATCH | 2BAR |
| 20 | | | |
| 21 | 2BAR | 1BAR | 1BAR |
| 22 | | | |
| 23 | 3 BAR | 3 BAR | CHERRY |
| 24 | | | |

*Fig. 10A*

| | | | | | |
|---|---|---|---|---|---|
| 1BAR | WILD1X | 3BAR | WILD1X | 2BAR | CHERRY |
| CHERRY | 2BAR | CHERRY | CHERRY | 1BAR | 1BAR |
| 3BAR | 3BAR | SEVEN | 3BAR | 2BAR | WILD1X |
| CHERRY | 1BAR | 3BAR | SEVEN | CHERRY | CHERRY |
| SEVEN | 2BAR | 1BAR | 2BAR | 1BAR | 1BAR |

*Fig. 10B*

| | | | | | |
|---|---|---|---|---|---|
| WILD2X | 3BAR | 2BAR | WILD2X | 1BAR | 1BAR |
| CHERRY | 1BAR | CHERRY | 2BAR | 2BAR | CHERRY |
| 3BAR | 3BAR | 2BAR | SEVEN | 3BAR | 3BAR |
| SEVEN | CHERRY | CHERRY | CHERRY | CHERRY | SEVEN |
| 1BAR | 2BAR | WILD2X | 1BAR | 1BAR | 1BAR |

*Fig. 10C*

| | | | | | |
|---|---|---|---|---|---|
| SEVEN | 3BAR | 2BAR | SEVEN | 2BAR | 1BAR |
| WILD3X | 2BAR | CHERRY | CHERRY | 1BAR | 1BAR |
| 3BAR | CHERRY | WILD3X | 1BAR | CHERRY | 1BAR |
| SEVEN | 1BAR | 3BAR | 2BAR | 1BAR | CHERRY |
| CHERRY | 3BAR | CHERRY | WILD3X | 2BAR | 3BAR |

*Fig. 10D*

| | | | | | |
|---|---|---|---|---|---|
| 3BAR | 3BAR | 3BAR | CHERRY | 3BAR | 2BAR |
| WILD5X | SEVEN | CHERRY | 1BAR | 1BAR | CHERRY |
| CHERRY | 1BAR | 1BAR | CHERRY | SEVEN | CHERRY |
| 1BAR | CHERRY | SEVEN | 3BAR | WILD5X | 2BAR |
| WILD5X | 2BAR | 1BAR | 2BAR | 2BAR | 1BAR |

*Fig. 11*

| | | | |
|---|---|---|---|
| 2 | 2 | 2 | 2 |
| 2 | 2 | 2 | 2 |
| 3 | 3 | 3 | 3 |
| 5 | 5 | 5 | 5 |

*Fig. 13a*

| BONUS GAME FOR 92% 3 COIN MAX BET GAME PLAYED WITH 1 COIN BET | | | | |
|---|---|---|---|---|
| SYMBOLS | | | | |
| WILD | 3 | | | |
| SEVEN | 3 | | | |
| 3BAR | 5 | | | |
| 2BAR | 5 | | | |
| CHERRY | 7 | | | |
| 1BAR | 7 | | | |
| | 30 | | | |
| | | | | |
| BONUS GAME PAY SCHEDULE FOR THREE PERFECT MATCH SYMBOLS SCATTERED IN DISPLAY WINDOW (PLAYED EVERY 66.46 PULLS) | | | | |
| COMB | PAY | PROB | EV | BONUS GAMES |
| WILD | 400 | 0.000246 | 0.098522 | 4060 |
| 777 | 100 | 0.0097 | 0.96997 | 103.098 |
| 7WW | 100 | 0.017355 | 1.735506 | 57.62009 |
| 77W | 100 | 0.045715 | 4.571524 | 21.87454 |
| 3BARS | 40 | 0.063674 | 2.546968 | 15.70495 |
| 3BARWW | 40 | 0.015968 | 0.63871 | 62.62624 |
| 3BARW | 40 | 0.101127 | 4.045081 | 9.888553 |
| 2BARS | 20 | 0.063674 | 1.273484 | 15.70495 |
| 2BARWW | 20 | 0.009589 | 0.191781 | 104.2854 |
| 2BARW | 20 | 0.088438 | 1.768768 | 11.30731 |
| CHERRIES | 15 | 0.158695 | 2.380432 | 6.301377 |
| CHERRYWW | 15 | 0.007854 | 0.117816 | 127.3171 |
| CHERRYW | 15 | 0.134002 | 2.010036 | 7.462552 |
| 1BARS | 10 | 0.158695 | 1.586955 | 6.301377 |
| 1BARWW | 10 | 0.005172 | 0.051724 | 193.3333 |
| 1BARW | 10 | 0.120093 | 1.200928 | 8.326891 |
| | | 1 | 25.18821 | |

Fig. 13b

| BONUS GAME PAY SCHEDULE FOR THREE PERFECT MATCH SYMBOLS ON PAY LINE (PLAYED EVERY 1728 PULLS) | | | | |
|---|---|---|---|---|
| COMB | PAY | PROB | EV | BONUS GAMES |
| WILD @ 5X | 12500 | 6.16E-05 | 0.769704 | 16240 |
| WILD @ 3X | 2700 | 6.16E-05 | 0.166256 | 16240 |
| WILD @ 2X | 800 | 0.000123 | 1.098522 | 8120 |
| 777 | 100 | 0.0097 | 0.96997 | 103.096 |
| 7WW @ 5X | 2500 | 0.004339 | 10.84691 | 230.4803 |
| 7WW @ 3X | 900 | 0.004339 | 3.904888 | 230.4803 |
| 7WW @ 2X | 400 | 0.008678 | 3.471012 | 115.2402 |
| 77W @ 5X | 500 | 0.011429 | 5.714406 | 87.49817 |
| 77W @ 3X | 300 | 0.011429 | 3.428643 | 87.49817 |
| 77W @ 2X | 200 | 0.022858 | 4.571524 | 43.74908 |
| 3BARS | 40 | 0.063674 | 2.546988 | 15.70495 |
| 3BARWW @ 5X | 1000 | 0.003992 | 3.991937 | 250.5049 |
| 3BARWW @ 3X | 360 | 0.003992 | 1.437097 | 250.5049 |
| 3BARWW @ 2X | 160 | 0.007984 | 1.27742 | 125.2525 |
| 3BARW @ 5X | 200 | 0.025282 | 5.056351 | 39.55421 |
| 3BARW @ 3X | 120 | 0.025282 | 3.033811 | 39.55421 |
| 3BARW @ 2X | 80 | 0.050564 | 4.045081 | 19.77711 |
| 2BARS | 20 | 0.063674 | 1.273484 | 15.70495 |
| 2BARWW @ 5X | 500 | 0.002397 | 1.198634 | 417.1416 |
| 2BARWW @ 3X | 180 | 0.002397 | 0.431508 | 417.1416 |
| 2BARWW @ 2X | 80 | 0.004795 | 0.383563 | 208.5708 |
| 2BARW @ 5X | 100 | 0.02211 | 2.21096 | 45.22922 |
| 2BARW @ 3X | 60 | 0.02211 | 1.326576 | 45.22922 |
| 2BARW @ 2X | 40 | 0.044219 | 1.768768 | 22.61461 |
| CHERRIES | 15 | 0.158695 | 2.380432 | 6.301377 |
| CHERWW @ 5x | 375 | 0.001964 | 0.736351 | 509.2683 |
| CHERWW @ 3x | 135 | 0.001964 | 0.265086 | 509.2683 |
| CHERWW @ 2x | 60 | 0.003927 | 0.235632 | 254.6341 |
| CHERW @ 5x | 75 | 0.033501 | 2.512545 | 29.85021 |
| CHERW @ 3x | 45 | 0.033501 | 1.507527 | 29.85021 |
| CHERW @ 2x | 30 | 0.067001 | 2.010036 | 14.9251 |
| 1BARS | 10 | 0.158695 | 1.586955 | 6.301377 |
| 1BARWW @ 5X | 250 | 0.001293 | 0.323276 | 773.3333 |
| 1BARWW @ 3X | 90 | 0.001293 | 0.116379 | 773.3333 |
| 1BARWW @ 2X | 40 | 0.002586 | 0.103448 | 386.6667 |
| 1BARW @ 5X | 50 | 0.030023 | 1.50116 | 33.30756 |
| 1BARW @ 3X | 30 | 0.030023 | 0.900698 | 33.30756 |
| 1BARW @ 2X | 20 | 0.060046 | 1.200928 | 16.65378 |
| | | 1 | 79.30445 | |

EXPECTED WIN FROM BONUS GAME TRIGGERED BY THREE PERFECT MATCH SYMBOLS SCATTERED IN DISPLAY WINDOW = 25.18821

EXPECTED WIN FROM BONUS GAME TRIGGERED BY THREE PERFECT MATCH SYMBOLS ON PAY LINE = 79.30445

GAMING DEVICE WITH VARIABLE BONUS PAYOUT FEATURE

CROSS-REFERENCE TO RELATED APPLICATION

This application is a continuation-in-part of U.S. application Ser. No. 09/140,947 filed Aug. 27, 1998, which is a continuation-in-part of U.S. application Ser. No. 08/835,840 filed Apr. 23, 1997.

FIELD OF THE INVENTION

The present invention relates generally to gaming machines. More particularly, the present invention relates to a slot machine having a spinning reel display and a secondary bonus game, wherein the bonus game has different expected values based on different arrangements of start-bonus symbols shown on the spinning reel display.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept which has been successfully employed to enhance the entertainment value of a game is the concept of a "secondary" or "bonus" game which may be played in conjunction with a "basic" game. The bonus game may comprise any type of game, either similar to or completely different from the base game, which is entered upon the occurrence of a selected event or outcome of the base game. The bonus game concept is the subject of U.S. parent patent application Ser. Nos. 08/835,840 ("the '840 application") filed Apr. 23, 1997 and 09/140,947 ("the '947 application") filed Aug. 27, 1998, both of which are assigned to the assignee of the present application and incorporated herein by reference in their entireties. The '840 and '947 applications disclose an embodiment wherein the base game is a reel-type slot machine and the bonus game is a simulated reel-type slot machine implemented on a video-type display. The bonus game is entered upon the appearance of a special symbol combination of start-bonus symbols on the reels of the slot machine in the base game. In the bonus game, the probability of winning combinations appearing on the reels, or the "hit rate," is much greater than that of the base game. The player is permitted to keep playing and accumulate winnings from the bonus game until a losing trial occurs. Such a bonus game produces a significantly higher level of player excitement than the base game because it provides a greater expectation of winning than the base game and is accompanied with more attractive or unusual video displays and/or audio.

Because the bonus game concept offers tremendous advantages in player appeal and excitement relative to other known games, and because such games are attractive to both players and operators, there is a continuing need to develop new features for bonus games to satisfy the demands of players and operators. Preferably, such new bonus game features will maintain, or even further enhance, the level of player excitement offered by bonus games heretofore known in the art. The present invention is directed to satisfying these needs.

SUMMARY OF THE INVENTION

In one embodiment, a slot machine comprises a spinning reel display and a bonus game. The spinning reel display shows a plurality of symbols on each of a plurality of rotatable reels. The reels are rotated and stopped to place the symbols of each reel in visual association with a pay line. The pay line is associated with at least one of the symbols on each of the reels. The bonus game is triggered in response to start-bonus symbols from the respective stopped reels appearing in the spinning reel display. The bonus game having different expected values based on different arrangements of the start-bonus symbols in the spinning reel display. The provision of different expected values for the bonus game based on different arrangements of start-bonus symbols shown on the spinning reel display is believed to enhance the level of player excitement and appeal.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which:

FIG. 3 is a symbol table for a 22 symbol reel-type slot machine augmented to include WinStreak bonus symbols and special blanks (WSBlank) immediately adjacent to the bonus symbols;

FIG. 4 is a set of reel strips for the symbol table of FIG. 3 for a base game;

FIG. 5 is a math table combining the expected value calculation for the base and bonus games according to a first embodiment of the invention;

FIG. 6 is a combined symbol and math table for the bonus game according to the first embodiment of the invention;

FIG. 9 is a set of reel strips for a base game according to a second embodiment of the invention;

FIGS. 10A through 10D are enlargements of a video-type display depicting a grid of windows for a bonus game according to the second embodiment of the invention;

FIG. 11 is a table used to randomly select the value of a Wild symbol multiplier in the bonus game according to the second embodiment of the invention;

FIGS. 13*a* and 13*b* are a combined symbol and math table for the bonus game according to the second embodiment of the invention.

Figure 1:
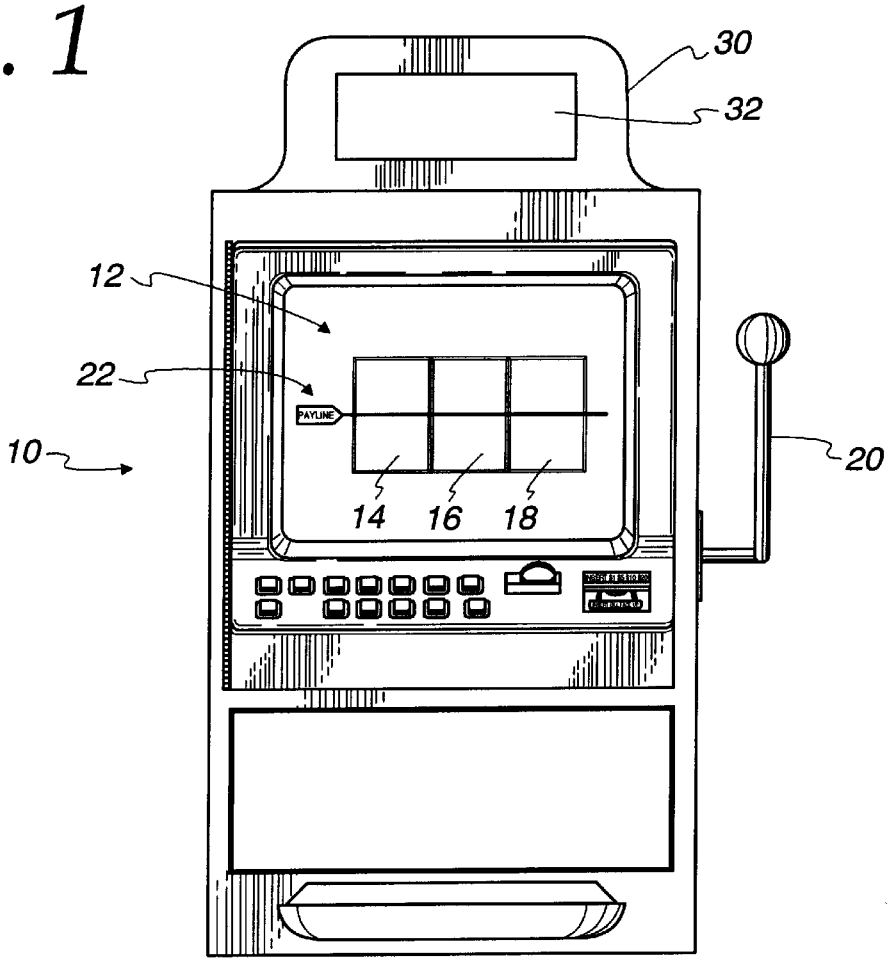
FIG. 1 is a simplified front view of a slot machine embodying the present invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

The present invention can be implemented using almost any type of gaming device. The game is divided into two parts: a base game and bonus game. When a trigger event occurs in the base game, play switches to the bonus game. Preferably, play of the bonus game results in a series of free trials, i.e. not requiring the game player to insert any additional coins or credits into the machine. Alternatively, however, the bonus game can be played by requiring coins or credits with the player knowing that his or her chance of winning has been significantly increased. If a bonus game trial results in a win, then the player receives the amount associated with that particular win. In a first embodiment of the present invention, trials continue in the bonus game until a losing trial occurs.

The base game and bonus game may be the same game system with different pay tables and rules. For example, the base game and bonus game may be executed on the reels of a spinning reel slot machine where the symbols on the reels are given two different sets of probabilities for the base and bonus games. Another alternative is for the two games to be very different, such as a spinning reel slot machine for the base game coupled with a video poker game as the bonus game. It is also contemplated, and disclosed herein as the first embodiment, to use a spinning reel slot machine as the base game and a slot machine simulation on a video display as the bonus game. It is further contemplated, and disclosed herein as a second embodiment, to use a spinning reel slot machine as the base game and a matching game on a video display as the bonus game. With reference to the programming and operation of processor-controlled slot machines, the reader is directed to the disclosures in U.S. Pat. Nos. 4,095,795 to Saxton and 5,456,465 to Durham, which are hereby incorporated by reference.

Figure 2:
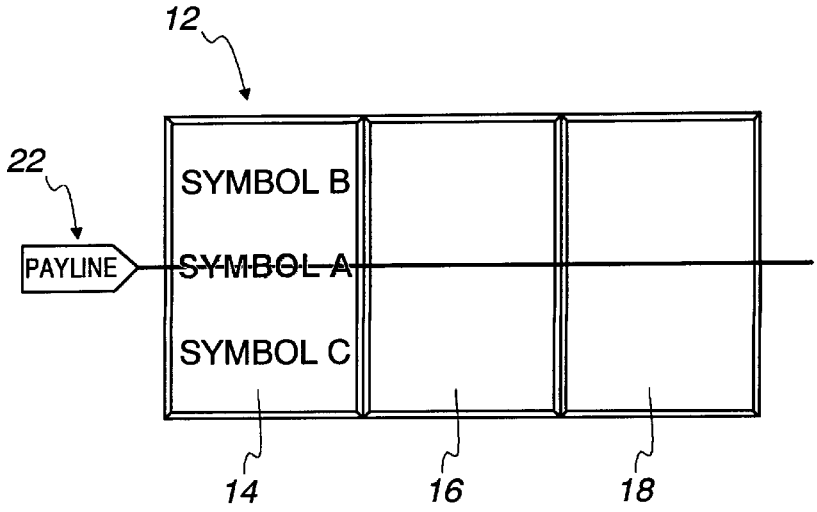
FIG. 2 is an enlargement of a display window of the slot machine showing how symbols appear on, above and below a pay line.

Referring to FIG. 1, there is shown a simplified diagram of a reel-type slot machine. The machine 10 includes a display window 12 through which a player may observe three spinning reels 14, 16 and 18. Game play is initiated by inserting a coin or playing a credit and then pulling the lever 20 or operating a push button switch for the same purpose. A microprocessor then operates according to its game program, randomly selecting a reel stop position for each of reels 14, 16 and 18. The reels are set in motion to give the player the feeling of randomness, but in due course the reels are stopped at the preselected stop positions using technology well known in this art which typically includes stepper motors for driving the reels and stopping them at the desired position under processor control. A pay line 22 is located centrally of the display 12. Symbols which stop on the pay line 22 are evaluated to determine if a winning combination has occurred. If so, in a typical slot machine, a payout is made and the game is over. In some games the symbols above and below the pay line 22 are also visible in the display window. This provides additional excitement to the player. In some games, the ability to see the next symbol, above and below the pay line, can be used to provide additional entertainment and payoff features. Thus, for example, as shown in FIG. 2, which is an enlargement of the display window 12, three symbols are visible on Reel 14. Symbol A is on the pay line, while symbol B is above the pay line and symbol C is below the pay line. Specific embodiments of the present invention make use of this feature of traditional slot machines in a manner to be explained hereafter.

Returning to FIG. 1, according to the first embodiment of the invention, the slot machine 10 is provided with a video-type display 32 which may be a CRT or a dot matrix display, as desired. The display is housed in a vertically disposed enclosure secured to the upper portion of the slot machine 10. The display 32 is used for purposes of playing a bonus game. If the bonus game is a poker game, for example, a poker hand would be shown on the display and the player paid if a winning hand occurs. Similarly, if the bonus game is a slot machine simulation, spinning symbols would be simulated on the display stopped in various combinations, some of which would constitute winners.

There will now be described the first embodiment of the invention, for implementing the invention in a commercial environment. It must be reiterated that this is only one such possibility and that any combination of two suitable games that are percentaged and interoperable according to the present invention may be used. The base game is played on the spinning reels of the slot machine 10, while the bonus game is played on the video-type display 32. The base game has typical symbols such as Cherry, Single Bar, Double Bar and Triple Bar spaced on the reel strips 14, 16 and 18. Typically these symbols will be randomly displayed on the reel strips, usually separate by a blank, which is itself a symbol. In addition to these standard slot machine symbols, the reel strips also carry a WinStreak bonus symbol, the selection of which leads to operation of the bonus game as will be described.

FIG. 3 is a table illustrating the reel strip symbol frequency for the base game of the first embodiment. The symbols which appear on Reel 1 include: the WinStreak bonus symbol, "special" WinStreak blanks on either side of the WinStreak bonus symbol, the 3Bar, 2Bar and 1Bar symbols, and regular blanks and Cherries for a total of 22 symbols one at each of 22 reel stop positions. Reels 2 and 3 are similar. A typical symbol layout for this example is shown in FIG. 4. The occurrence of the various symbols varies from reel to reel, but each reel has 22 symbols in all and therefore the odds of any possible combination of distinct symbols appearing on the pay line is 1 in 10,648 (22×22×22). Thus, according to a first implementation of the invention, the base game may be a standard processor-controlled spinning reel slot machine, augmented however, with bonus symbols and special blanks. It is substantially similar to the system described in U.S. Pat. No. 4,095,795 to Saxton, albeit a different software algorithm is employed for selecting the symbols.

As with most such games, the payout table is set so that the machine retains a percentage of the money played (the hold percentage). Calculation of the hold percentage of the machine, however, requires inclusion of the bonus game. For illustrative purposes, a typical pay schedule for the reel strips of FIG. 4 is shown in FIG. 5. The schedule includes the calculated payouts of the bonus game as will be discussed hereafter. FIG. 5 also shows the probability of occurrence of winning combinations and the expected value (EV) from which the hold percentage is calculated. Thus, for the reel strips of FIG. 4, the probability of 3 bars occurring is 0.000376 and since it pays 50 coins the EV is (50× 0.000376)=0.018783. By summing the EV's for all winning combinations, including the bonus game combinations represented in the schedule as "3WinStreak" and "3AnyStreak", it can be determined that the illustrated embodiment has a payout percentage of 94.4045. That is, for every dollar played, on average, about 94 cents will be returned to the player and 6 cents will be retained as profit.

In the base game when three bonus symbols appear in the display 12 (either on the pay line or above or below the pay line) the bonus game is initiated. If the three bonus symbols are on the pay line, according to the described embodiment, the bonus game is initiated with all awards doubled. According to the first embodiment, the bonus game is implemented in a video-type display shown at 32 in FIG. 1. This display is utilized by the processor to simulate a spinning reel slot machine. The symbols used in the bonus game are Cherry, Single Bar, Double Bar, Triple Bar, Blue 7 and Red 7. This is shown in the pay table of FIG. 6. As will be apparent in this example, some symbols appear in the bonus game which do not appear on the base game reel strips. For simplicity, it is preferable, but not necessary, that the bonus game and base game use the same pay table for common symbols, i.e. the same award for 1 or 2 Cherries and for Any Bar, Single Bar, Double Bar and Triple Bar combinations. Typically posted on the outside of the machine is such a combined pay table including the awards for the 3 Cherries, Any 7, Blue 7 and Red 7 which are only available in the bonus game.

In the illustrated implementation, there are 22 reel stop positions on each of three reels of the base game (See FIG. 3). The machine uses a probability of 1 in 22 for each reel stop position on each reel. The WinStreak bonus symbols appear two times (at two stop positions) on the first reel, three times on the second reel and once on the third reel. Thus, the probability of three WinStreak symbols on the pay line has a probability of (2*3*1)/(22*22*22)= 0.0005634861=A. This is equal to 1 in 1774.667 spins. Preferably, the multiple instances of the WinStreak symbol on reels 1 and 2 are placed at least four stop positions apart such as shown in FIG. 4. As a result, the blanks above and below the WinStreak symbols will put a WinStreak bonus symbol within one position of the pay line. This provides three times the number of reel stop positions as there are WinStreak Symbols which may trigger the bonus game. The probability of entering the bonus game is (6*9*3)/ (22*22*22)=0.0152141247=B. In summary, a 2X multiplier bonus game (three WinStreak symbols on the pay line) will be achieved with a probability of A. The probability of a regular bonus round played with a 1X multiplier is B-A.

The following discussion of the bonus game mathematics focuses on a single coin implementation. It is well known how to extend this to two-coin, three-coin, five-coin or other versions allowing more than one coin to be wagered on each base game.

The expected return on a slot machine is computed by combining the probability of each award with the amount of the award as indicated in FIGS. 5 and 6. The expected value (EV) of each award is computed by taking the product of the probability of achieving the award and the number of coins played. The sum of each of these products results in the expected return of the slot machine. This result will be in the form of a fraction of one coin. The result of the combined game (base and bonus games) is computed by using this method for each regular symbol combination of the base game, to which is added the expected value of the bonus game combinations. The expected value of the bonus game is computed by multiplying the probability of getting to the bonus game by the expected number of coins awarded in the bonus game. Call the expected value (EV) for coins won in the bonus game "C". The value "C" is formed from two entries. Entry 1 is the probability of playing the bonus round with a 1X multiplier B-A from the preceding discussion times the EV of the bonus game or ((B-A)*C). Entry 2 is the probability of playing the bonus round with a 2X multiplier (A), times the EV of the bonus game times two or (A*C*2). To obtain the value C requires additional information.

The expected value for each spin of the bonus game is computed in the same manner described above, computing the sum of expected values for each possible award. While any commercially successful slot machine must have an expected value of less than 1.00, this restriction does not apply to the bonus game per se. Rather, as long as the value C, when inserted into the expected value equation for the entire game, results in a return for the entire game of less than 1.00, the expected value for the bonus game may be greater than 1.00. The expected coins per spin of the bonus game in the example is X coins. By computing S, the expected number of spins until a loss occurs in the bonus game, C is then computed as the product of this number of spins, times the coins expected per spin X. That is, C=S * X. For the example of FIG. 6, the value X is 4.1751 (the sum of the EV column) while the hit rate is 84.41% producing a value of S=6.4145. Thus, C=6.4145 * 4.175=26.781.

Referring to FIG. 5, the computed values C and 2C (for the 2X multiplier feature) appear in the pay column as the first two entries and are included in the EV column computations which sum to a 94.4045% hold. Thus, the expected win for the bonus game is combined with the expected win for the base game to determine the expected value of the combined game.

By providing a two stage gaming process in which a traditional game of chance is played as the base game, the existing concept with which players are familiar and comfortable is retained. At the same time, however, a significantly more exciting feature is added in the form of a bonus game. The software implementation of the invention, according to the described embodiment, is relatively straightforward and will be easily understood by those skilled in the art. As the specific programming is dependent upon the hardware employed, including the type of microprocessor selected, it is not useful to provide detailed software listings. For completeness, however, FIGS. 7 and 8 contain flow diagrams of the manner in which the base and bonus games are implemented in a processor based system. From these diagrams, those skilled in the art will be readily able to program the invention described herein.

Figure 7:
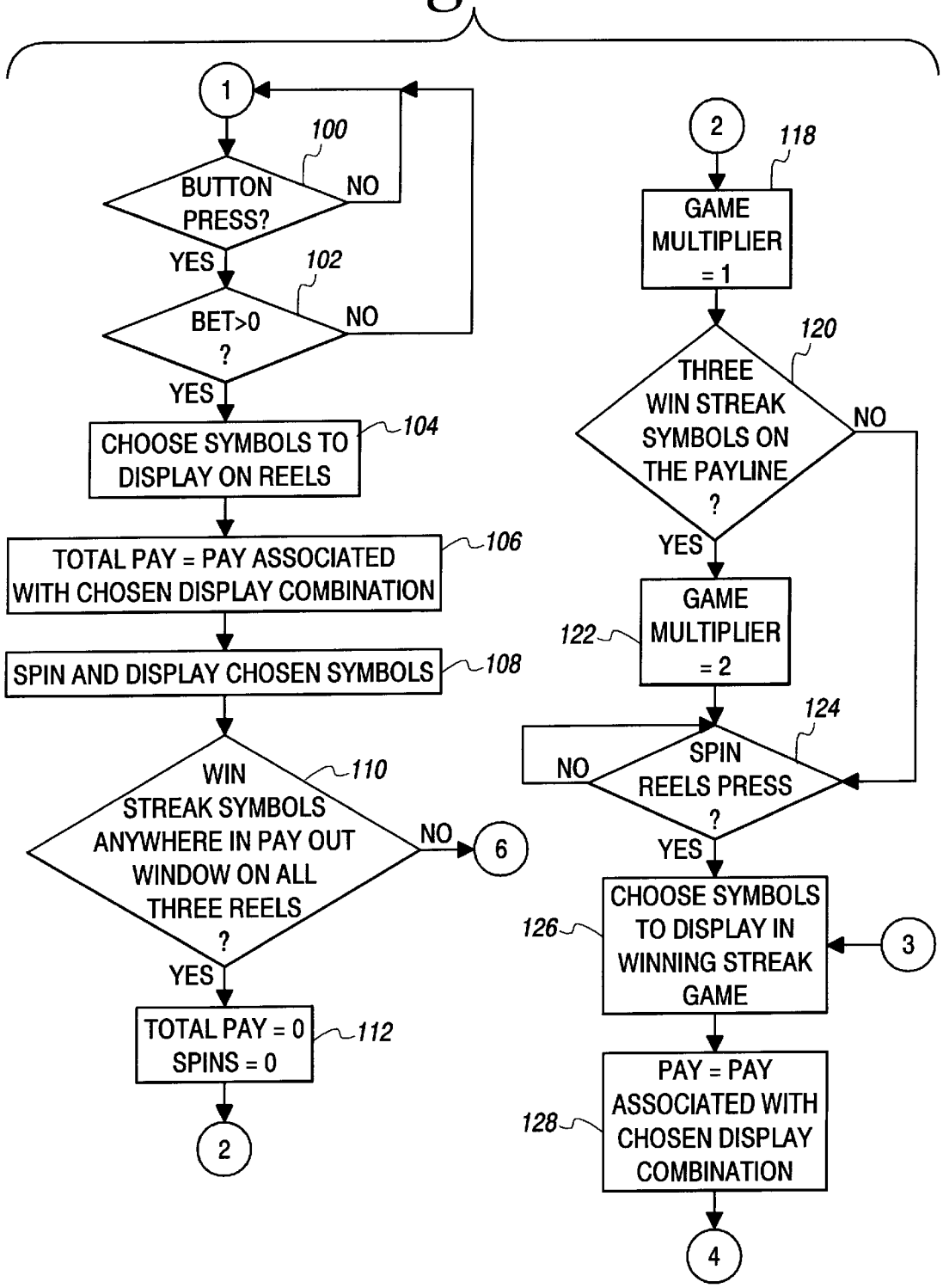
FIGS. 7 and 8 are software flow diagrams illustrating how the first embodiment of the invention may be implemented.
Figure 8:
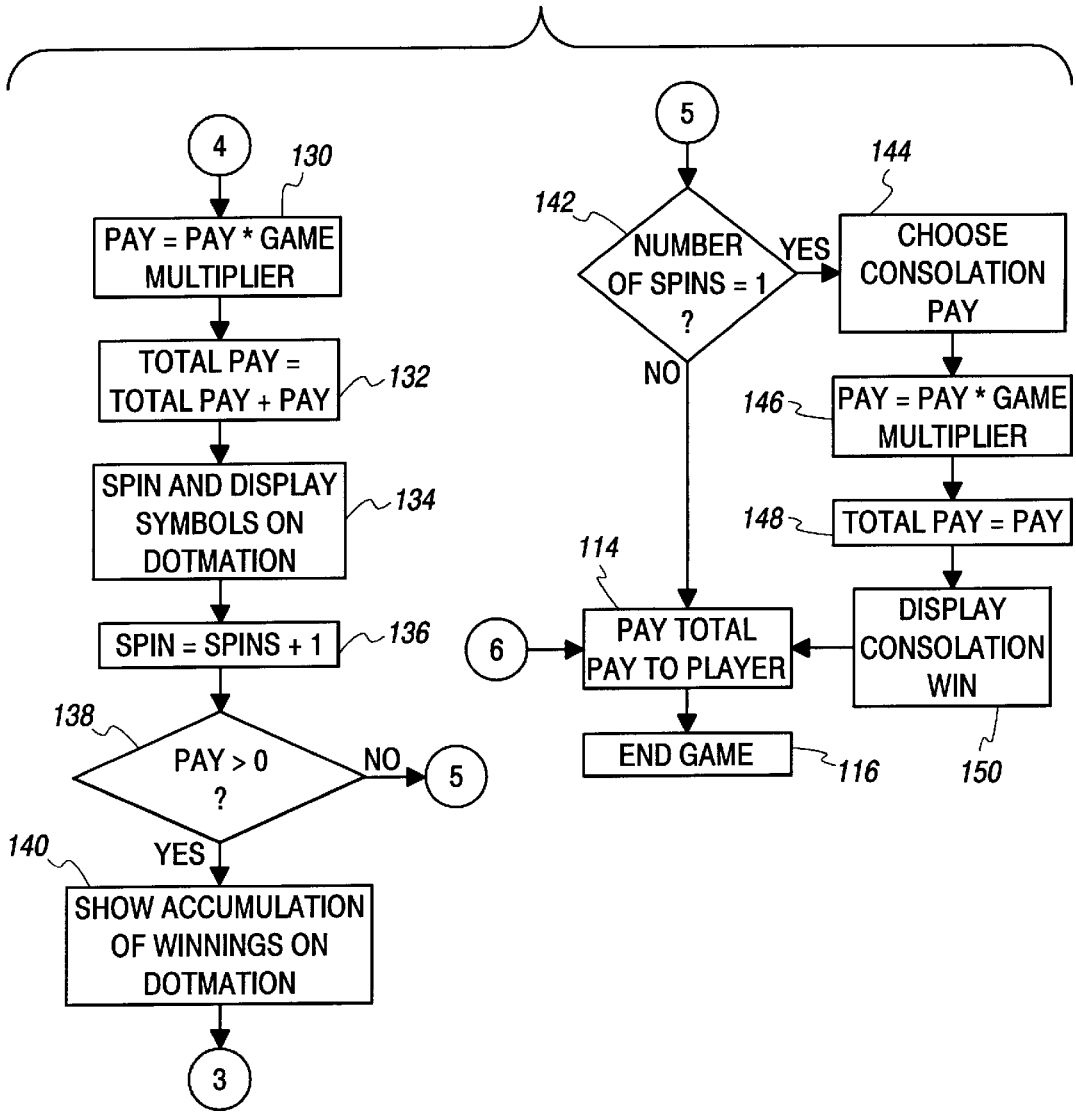

Referring to FIGS. 7 and 8, initially the processor waits until the player has pulled the handle or pressed a switch to initiate operation of the game. In addition, it is required that the player has placed a bet, i.e. that the amount wagered is greater than zero (Steps 100 and 102). The processor then uses any well known and accepted random number generator algorithm to choose the symbols for display on the reels of the base game (Step 104). A tentative value, Total Pay, is computed based upon a pay table for the selected symbol combination (Step 106). The reels 14, 16 and 18, in the case of the slot machine 10 of FIG. 1, are spun for a period of time and then stopped so that the symbols selected appear on the pay line (Step 108). Before awarding credits to the player, in the event a winning combination appears on the pay line, the program, according to the present invention, first checks to see if one WinStreak symbol appears on each reel (Step 110). If so, a bonus game has been earned and the program branches to Step 112 setting the Total Pay value to zero and the spin count to zero in preparation for initiating operation of the bonus game. If WinStreak symbols do not appear on each reel, either on the pay line or above or below the pay line, then the program branches to the circle labeled 6 in FIG. 8 where the tentative Total Pay computed in Step 106 is paid or credited to the player (Step 114) and the game ends (Step 116). As thus far described, this is the operation of a standard slot machine because the bonus feature was not invoked. The player must continue playing the game as described until a WinStreak symbol appears on each reel within the pay window to initiate operation of the bonus game.

When that occurs, the program, at Step 112, branches to the bonus game indicated on FIG. 7 beginning at the circle labeled 2. At Step 118 the bonus game multiplier is set equal to one. The program then checks, at Step 120, to determine if the three WinStreak symbols are on the pay line. If so, the game multiplier is reset to two (Step 122). In either case, the program then proceeds to wait for the player to initiate operation of the bonus game by pressing a button or pulling a lever at Step 124. This initiates operation of the bonus game display, which in the illustrated embodiment, is played on the video-type display 32 of FIG. 1. The processor again uses its random number algorithm to choose the symbols to be displayed for the bonus game (Step 126). A value "Pay" is set equal to the number of coins associated with the chosen display combination at Step 128 and the program continues as shown in FIG. 8 in the circle numbered 4. The Pay value is multiplied by the game multiplier (Step 130) as a function of the outcome of the decision box 120. A cumulative value, Total Pay, is computed as being equal to the previous Total Pays plus the current Pay (Step 132). The program next goes through the process of providing an animation of spinning reels on the dot matrix display and, as the reels appear to stop, the selected symbols appear (Step 134). The spin value is then incremented (Step 136) in preparation for the next cycle of the bonus game. Before commencing the next cycle, however, it is determined at Step 138 if the player has won or lost. If the player has won, the accumulated winnings are displayed to the player at Step 140 and the next cycle of the bonus round commences by branching back to FIG. 7 beginning at the circle labeled 3.

If, however, it is determined at Step 138 that the player has lost, the program branches to the circle labeled 5. The program then determines whether the value of the spin counter is equal to one, indicating that the player lost on his first turn in the bonus round (Step 142). If so, according to a first embodiment of the invention, a consolation award is given. The program chooses a consolation pay amount (Step 144) using a random selection algorithm. After the processor chooses a consolation pay amount, the chosen pay amount is multiplied by the game multiplier (either one or two) and the total pay is set equal to the multiplied pay amount (Steps 146, 148). Finally, the amount of the consolation win is displayed, Step 150, and then payment is made at Step 114. If the bonus round loss occurs after the first spin, the program goes from Step 142 to Step 114 where the player is credited with the Total Pay won to that point and the game ends at Step 116.

Referring to FIG. 1, a second embodiment of the present invention uses the spinning reel slot machine as the base game and a matching game on the video-type display 32 as the bonus game. With respect to the base game, the reel strips in FIG. 9 are similar to those described above in connection with FIG. 2 except that the WinStreak bonus symbol is replaced with a PerfectMatch bonus symbol and the remaining symbols (i.e. Cherry, Single Bar, Double Bar, Triple Bar, and blanks) are arranged on the reel strips as shown in FIG. 9. Also, each reel strip includes 24 reel stop positions.

Referring to FIGS. 10A through 10D, the matching game on the video-type display 32 includes a grid of windows (tiles). Each window hides one of six different types of symbols that are randomly placed in the grid. The symbols used in the bonus game are Single Bar (1Bar), Double Bar (2Bar), Triple Bar (3Bar), Cherry, Seven, and Wild symbols. The Wild symbols are also multipliers worth 1X, 2X, 3X, or 5X. FIG. 10A depicts a typical grid of windows on the display 32 where the Wild symbol (Wild1X) is a multiplier worth 1X; FIG. 10B depicts a typical grid of windows where the Wild symbol (Wild2X) is a multiplier worth 2X; FIG. 10C depicts a typical grid of windows where the Wild symbol (Wild3X) is a multiplier worth 3X; and FIG. 10D depicts a typical grid of windows where the Wild symbol (Wild5X) is a multiplier worth 5X. A player cannot see the symbols behind the windows until the player selects a window, at which time the symbol behind the selected window is revealed. The payout percentage of the slot machine may be varied by changing the frequency of each symbol appearing in the grid.

The matching bonus game is triggered in response to three PerfectMatch bonus symbols appearing in the display window 12 in FIG. 1 (either on the pay line 22 or above or below the pay line 22). If the three PerfectMatch symbols appear in the display window are not all on the pay line 22, then all of the Wild symbols in the bonus game are worth 1X. If, however, the three PerfectMatch symbols appearing in the display window are on the pay line 22, then all of the Wild symbols in the bonus game are worth either 2X, 3X, or 5X based upon a random selection of a multiplier value from the Wild multipliers table in FIG. 11. The illustrated table includes sixteen spaces, and each of the spaces contains a multiplier value. The probability of any one space being selected is one in sixteen. Therefore, the likelihood of the Wild symbol being worth 2X is 50 percent because the multiplier 2 occupies one-half of the spaces in the table. Similarly, the likelihood of the Wild symbol being worth 3X is 25 percent because the multiplier 3 occupies one-fourth of the spaces in the table, while the likelihood of the Wild symbol being worth 5X is 25 percent because the multiplier 5 occupies the remaining one-fourth of the spaces in the table. The payout percentage of the slot machine may be varied by changing the percentage of spaces occupied by each multiplier in the table in FIG. 11. The Wild symbols associated with any given round of the bonus game preferably have the same multiplier value, i.e., all Wild symbols appearing in any one grid of windows have the same multiplier value. It, however, is contemplated that the bonus game may be modified to include Wild symbols having different multiplier values in the same grid.

When the bonus game is entered, the symbols used in the bonus game (including the appropriate Wild symbols) are randomly placed behind the windows of the grid. Next, the player selects windows from the grid of windows appearing on the display 32 until the selected window completes a match of three symbols. Any Wild symbols uncovered by the player help to complete a match and, at the same time, multiply the payout associated with the three matched symbols by the multiplier associated with the uncovered Wild symbol. If no Wild symbols are used to complete a match of three symbols, the player is simply awarded a payout based upon a pay table for the uncovered match. If, however, one or more Wild symbols are used to complete a match, then the payout based upon the pay table is cumulatively multiplied by the multiplier associated with each uncovered Wild symbols. For example, if the multiplier associated with a Wild symbol is worth 3X and two such Wild symbols are uncovered to complete a match, then the payout is multiplied by 9=3×3.

Figure 12:
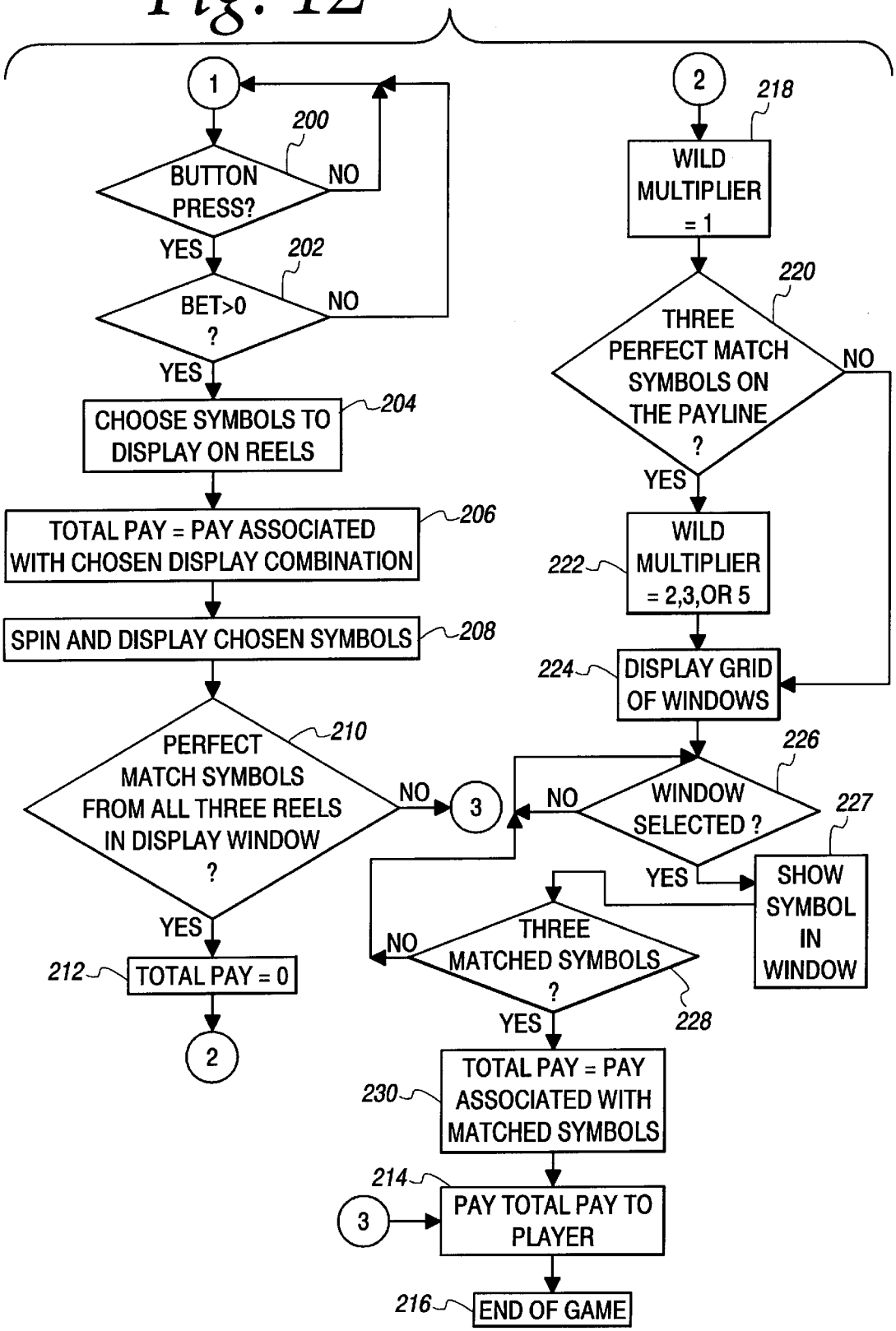
FIG. 12 is a software flow diagram illustrating how the second embodiment of the invention may be implemented.

FIG. 12 is a software flow diagram illustrating how the second embodiment of the invention may be implemented. Initially the processor waits until the player has pulled the handle or pressed a switch to initiate operation of the game. In addition, it is required that the player has placed a bet, i.e. that the amount wagered is greater than zero (Steps 200 and 202). The processor then uses any well known and accepted random number generator algorithm to choose the symbols for display on the reels of the base game (Step 204). A tentative value, Total Pay, is computed based upon a pay table for the selected symbol combination (Step 206). The reels 14, 16 and 18, in the case of the slot machine 10 of FIG. 1, are spun for a period of time and then stopped so that the symbols selected appear on the pay line (Step 208). Before paying or awarding credits to the player, in the event a winning combination appears on the pay line, the program, according to the present invention, first checks to see if PerfectMatch symbols from all three reels appear anywhere in the display window (Step 210). If so, a bonus game has been earned and the program branches to Step 212 setting the Total Pay value to zero in preparation for initiating operation of the bonus game. If PerfectMatch symbols do not appear on each reel, either on the pay line or above or below the pay line, then the program branches to the circle labeled 3 in FIG. 12 where the tentative Total Pay computed in Step 206 is paid or credited to the player (Step 214) and the game ends (Step 216). As thus far described, this is the operation of a standard slot machine because the bonus feature was not invoked. The player must continue playing the game as described until PerfectMatch symbols from all three reels appear in the pay window to initiate operation of the bonus game.

When that occurs, the program, at Step 212, branches to the bonus game indicated on FIG. 12 beginning at the circle labeled 2. At Step 218 the Wild multiplier is set equal to one (1X). The program then checks, at Step 220, to determine if the three PerfectMatch symbols are on the pay line. If so, the Wild multiplier is randomly selected to be either two (2X), three (3X), or five (5X) using the Wild multipliers table in FIG. 11 (Step 222). In either case, the program then proceeds to display a grid of windows on the video-type display 32 in FIG. 1 at Step 224. The bonus game symbols, including the selected Wild symbol, are randomly placed behind the windows of the grid. FIGS. 10A, 10B, 10C, and 10D depict illustrative grids containing the respective Wild symbols Wild1X, Wild2X, Wild3X, and Wild5X. Next, the program waits for the player to use a button to select windows in the displayed grid at Step 226 and thereby reveal the bonus game symbols behind the selected windows at Step 227. After each window selection, the program checks, at Step 228, to see if the symbol behind the last selected window completes a match of three symbols. Any Wild symbols uncovered by the player help to complete a match. When the program determines that the player has uncovered three matching symbols, the program computes the Total Pay, at Step 230, based upon a pay table for the uncovered match and any Wild symbols used to complete the match. The Total Pay is then paid or credited to the player (Step 214) and the game ends (Step 216).

FIGS. 13*a* and 13*b* are a combined symbol and math table for the bonus game according to the second embodiment of the invention. Although the table relates to a single coin implementation, it is well known how to extend this to two-coin, three-coin, five-coin or other versions allowing more than one coin to be wagered on the base game. The upper portion of the table in FIG. 13*a* identifies the bonus game symbols and the frequency of each symbol appearing in the bonus game. For example, the Wild symbol occupies three windows in the grid of the matching bonus game; the Seven symbol occupies three windows; the Triple Bar (3Bar) symbol occupies five windows; and so on. Because there are thirty windows in the grid, the sum of the frequencies of the different symbols is thirty.

The lower portion of the table in FIG. 13*a* depicts a bonus game pay schedule when the bonus game is triggered by three PerfectMatch symbols appearing in the display window but not all on the pay line. The first column of the pay schedule includes different matches (Comb) that result in the respective payouts (Pay) in the second column. For example, a match of three Wild symbols generates a payout of 400 coins; a match of three Seven symbols generates a payout of 100 coins; a match of one Seven symbol and two Wild (W) symbols generates a payout of 100 coins; and so on. To calculate the expected value (EV) in the fourth column for a particular match, the probability (Prob) of obtaining the match in the third column is multiplied by the payout (Pay) associated with that match in the second column. For example, with respect to the match of one Double Bar (2Bar) symbol and two Wild (W) symbols, EV=Pay * Prob=20 * 0.009589=0.191781. As noted above, when the bonus game is triggered by three PerfectMatch symbols appearing in the display window but not all on the pay line, the Wild symbol has a multiplier value of one (1X). The sum of the expected values of the individual matches listed in FIG. 13*a* is 25.18821.

The table in FIG. 13*b* depicts a bonus game pay schedule when the bonus game is triggered by three PerfectMatch symbols appearing in the display window on the pay line. As in FIG. 13*a,* the first column of the pay schedule includes different matches (Comb) that result in the respective payouts (Pay) in the second column. For example, a match of three Wild symbols with a multiplier value of five (Wild (@5X) generates a payout of 12500 coins; a match of three Wild symbols with a multiplier value of three (Wild @3X) generates a payout of 2700 coins; a match of three Wild symbols with a multiplier value of two (Wild @2X) generates a payout of 800 coins; a match of three Seven symbols generates a payout of 100 coins; a match of one Seven symbol and two Wild symbols with a multiplier value of five (WW @5X) generates a payout of 2500 coins; and so on. To calculate the expected value (EV) in the fourth column for a particular match, the probability (Prob) of obtaining the match is multiplied by the payout (Pay) associated with that match. For example, with respect to the match of one Triple Bar (3Bar) symbol and two Wild symbols with a multiplier value of three (WW @3X), EV=Pay * Prob=360 * 0.003992=1.437097. As noted above, when the bonus game is triggered by three PerfectMatch symbols appearing in the display window on the pay line, the Wild symbol has a multiplier value randomly selected to be either two (2X), three (3X), or five (5X). The sum of the expected values of the individual matches listed in FIG. 13*b* is 79.30445, which is greater than the total expected value of 25.18821 in FIG. 13*a*.

The probabilities (Prob) of obtaining the various matches (Comb) listed in the tables of FIGS. 13*a* and 13*b* are derived by enumerating and calculating the probability of every winning match possible in the bonus game. The bonus game consists of selecting symbols in a grid of thirty windows until a selected window completes a match of three identical symbols, where Wild symbols can be used to complete a match. Because there are six different symbols hidden in the grid, i.e., 1Bar, 2Bar, 3Bar, Cherry, Seven, and Wild, the minimum number of selections to achieve a match is three and the maximum number of selections to achieve a match is eleven. This information establishes the limits of the probability calculation. In the following explanation of the probability calculation, the following abbreviations are used:

| | | | |
|---|---|---|---|
| W = Wild | 7 = Seven | C = Cherry | 1 = 1Bar |
| 1 = 1Bar | 2 = 2Bar | 3 = 3Bar | |
| X = any non-winning symbol | | | |
| N = number of symbols | | | |
| P = probability | | | |

The following examples illustrate how the probabilities (Prob) in the lower portion of the table in FIG. 13*a* are obtained. Referring to FIG. 13*a,* the match (Comb) of three Wild symbols (Wild or WWW) yields a Pay of 400 coins and has a probability (Prob) of 0.000246. The match of three Wild symbols can only occur in response to selecting three straight Wild symbols on a player's first three selections. This probability is calculated as follows:

P=(N of Wilds/30) * (N of Wilds−1)/29 * (N of Wilds−2)/28

The upper portion of the table in FIG. 13*a* shows that there are three Wild symbols in the grid of thirty windows. Therefore:

P=3/30 * 2/29 * 1/28=6/24360=0.000246

The probability calculations for the other matches shown in the lower portion of the table in FIG. 13*a* are more complex. For example, the match of three Seven symbols (777) can be achieved by selecting three straight Seven symbols on a player's first three selections or by selecting a Seven symbol as the last selection anywhere up to the player's eleventh selection. This enumeration breaks down as follows:

| | | | |
|---|---|---|---|
| 777 | X777 | XX777 | XXX777 |
| XXXX777 | XXXXX777 | XXXXXX777 | |
| XXXXXXX777 | XXXXXXXX777 | | |

Each of the above enumerations must be further enumerated. For example, X777 can be 1777, 2777, 3777, and C777; XX777 can be 11777, 22777, 33777, CC777, 12777, 13777, 1C777, 21777, 23777, 2C777, 31777, 32777, 3C777, C1777, C2777, and C3777; and so on. The probability (Prob) of selecting a 1Bar followed by three Seven symbols is:

P=(N of 1Bars/30) * (N of 7s/29) * (N of 7s−1)/28 * (N of 7s−2)/27

It must be kept in mind that a 777 match with a wasted 1Bar selection can be achieved in multiple ways—X777 (where X is the 1Bar) can be selected as 1777, 7177, and 7717. The same can be said where X is a Cherry, X is a 2Bar, and X is a 3Bar. Every possible wasted symbol combination must be enumerated, and then its placement is the selection order must also be enumerated. Such a probability enumeration and calculation can be accomplished by one of ordinary skill in the art. The probability (Prob) shown in the table in FIG. 13*a* for a 777 match is the sum of all the individual 777 win enumerated probabilities.

The probabilities (Prob) in the table in FIG. 13*b* are calculated in the same manner as the probabilities in FIG. 13*a* except that the Wild symbols are broken out by multipliers because the bonus game associated with FIG. 13*b* assigns multipliers of 2X, 3X, or 5X to the Wild symbols. The probability of each multiplier shown in FIG. 11 must be calculated and then factored into its respective Wild probability in FIG. 13*b*.

It can be seen that the bonus games in both the first and second embodiments of the present invention have different expected values based on different arrangements of the three start-bonus symbols (e.g., WinStreak or PerfectMatch symbols) in the display window of the base game that trigger the bonus game (see FIGS. 5, 6, 13*a,* and 13*b*). Specifically, the bonus game provides a first expected value when at least one of the three start-bonus symbols in the display window of the base game does not coincide with the pay line. The bonus game has a second expected value, greater than the first expected value, when all three of the start-bonus symbols in the display window of the base game coincide with the pay line. In the illustrated embodiments, the different expected values stem from variations in the value of a bonus multiplier used to multiply a payout produced by the bonus game. In particular, the multiplier has a first value when at least one of the three start-bonus symbols in the display of the base game does not coincide with the pay line, while the multiplier has a second value, equal to some multiple of the first value, when all three of the start-bonus symbols in the display window of the base game coincide with the pay line. These different multiplier values resulting from the different arrangements of the start-bonus symbols in the display window of the base game generate the different expected values in the bonus game.

While the present invention has been described with reference to one or more particular embodiments, those skilled in the art will recognize that many changes may be made thereto without departing from the spirit and scope of the present invention.

For example, the illustrated slot machines provide different bonus multipliers, and therefore different expected values in the bonus game, based on whether the start-bonus symbols (e.g., WinStreak or PerfectMatch symbols) in the display window of the base game appear (1) on the pay line versus (2) anywhere in the display window but not all on the pay line. With respect to slot machines having base games with multiple pay lines, this technique of varying the bonus multiplier can be extended to providing different bonus multipliers based on the start-bonus symbols appearing on different pay lines of the base game. The bonus multiplier would have a first value when the start-bonus symbols in the display window of the base game appear on a first pay line, the bonus multiplier would have a second value when the start-bonus symbols appear on a second pay line, and so on.

In another alternative embodiment, features of the bonus game in addition to the bonus multiplier are varied based on different arrangements of the start-bonus symbols in the display window of the base game. For example, the bonus game could be divided into subsidiary games such as video poker and simulated slot reels. One arrangement of the start-bonus symbols in the display window of the base game would trigger the bonus game to play video poker, while another arrangement of the start-bonus symbols in the display window of the base game would trigger the bonus game to play slots on the bonus display. These subsidiary games could have the same or different expected values.

Each of these embodiments and obvious variations thereof is contemplated as falling within the spirit and scope of the claimed invention, which is set forth in the following claims.

What is claimed is:

1. A slot machine, comprising:

a spinning reel display showing a plurality of symbols on each of a plurality of rotatable reels, said reels being rotated and stopped to place said symbols of each reel in visual association with a pay line, said pay line being associated with at least one of said symbols on each of said reels; and a bonus game triggered in response to start-bonus symbols from said respective stopped reels appearing in said spinning reel display, said bonus game having different expected values based on different arrangements of said start-bonus symbols in said spinning reel display.

2. The slot machine of claim 1, wherein said bonus game provides first and second different expected values, said bonus game having said first expected value when at least one of said start-bonus symbols in said spinning reel display does not coincide with said pay line, said bonus game having said second expected value when all of said start-bonus symbols in said spinning reel display coincide with said pay line.

3. The slot machine of claim 2, wherein said second expected value is greater than said first expected value.

4. The slot machine of claim 2, wherein said bonus game has said first expected value when at least one of said start-bonus symbols in said spinning reel display appears one symbol position away from said pay line such that said start-bonus symbols are in a scatter-pay configuration.

5. The slot machine of claim 1, wherein said bonus game has a multiplier associated therewith for multiplying a payout produced by said bonus game, said multiplier having different values based upon different arrangements of said start-bonus symbols in said spinning reel display, said different values of said multiplier generating said different expected values for said bonus game.

6. The slot machine of claim 5, wherein said multiplier has a first value when at least one of said start-bonus symbols in said spinning reel display does not coincide with said pay line, said multiplier having a second value when all of said start-bonus symbols in said spinning reel display coincide with said pay line.

7. The slot machine of claim 6, wherein said second value of said multiplier is a multiple of said first value of said multiplier.

8. The slot machine of claim 1, wherein said spinning reel display includes a video screen showing video images of said reels.

9. The slot machine of claim 1, wherein said reels are mechanical and said spinning reel display includes a window through which said plurality of symbols on each of said mechanical reels are viewed.

10. The slot machine of claim 1, wherein said bonus game includes a bonus display showing a plurality of symbols on at least one rotatable bonus reel.

11. The slot machine of claim 1, wherein said bonus game includes a bonus display showing a grid of windows hiding bonus game symbols which are revealed upon selection of their respective windows.

12. The slot machine of claim 1, wherein said bonus game includes a bonus display showing a poker hand.

13. The slot machine of claim 1, wherein said bonus game provides first and second different expected values, said bonus game having said first expected value when all of said start-bonus symbols in said spinning reel display coincide with another pay line different from said pay line, said bonus game having said second expected value when all of said start-bonus symbols in said spinning reel display coincide with said pay line.

14. A slot machine, comprising:

a spinning reel display showing a plurality of symbols on each of a plurality of rotatable reels, said reels being rotated and stopped to place said symbols of each reel in visual association with a pay line, said pay line being associated with at least one of said symbols on each of said reels; and a bonus game triggered in response to start-bonus symbols from said respective stopped reels appearing in said spinning reel display, said bonus game having a multiplier associated therewith for multiplying a payout produced by said bonus game, said multiplier being different based upon different arrangements of said start-bonus symbols in said spinning reel display.

15. The slot machine of claim 14, wherein said multiplier has a first value when at least one of said start-bonus symbols in said spinning reel display does not coincide with said pay line, said multiplier having a second value when all of said start-bonus symbols in said spinning reel display coincide with said pay line.

16. The slot machine of claim 15, wherein said second value is greater than said first value.

17. The slot machine of claim 16, wherein said second value is a multiple of said first value.

18. The slot machine of claim 17, wherein said first value is one and said second value is selected from a group consisting of two, three, and five.

19. A method of providing different expected values for a bonus game of a slot machine, said method comprising:

providing said slot machine, said slot machine including a spinning reel display and said bonus game, said spinning reel display showing a plurality of symbols on each of a plurality of rotatable reels;

rotating and stopping said reels to place said symbols of each reel in visual association with a pay line, said pay line being associated with at least one of said symbols on each of said reels; and triggering said bonus game in response to start-bonus symbols from said respective stopped reels appearing in said spinning reel display, said bonus game having different expected values based on different arrangements of said start-bonus symbols in said spinning reel display.

20. The method of claim 19, wherein said bonus game provides first and second different expected values, said bonus game having said first expected value when at least one of said start-bonus symbols in said spinning reel display does not coincide with said pay line, said bonus game having said second expected value when all of said start-bonus symbols in said spinning reel display coincide with said pay line.

21. The method of claim 20, wherein said second expected value is greater than said first expected value.

22. The method of claim 19, wherein said bonus game has a multiplier associated therewith for multiplying a payout produced by said bonus game, said multiplier having different values based upon different arrangements of said start-bonus symbols in said spinning reel display, said different values of said multiplier generating said different expected values for said bonus game.

23. The method of claim 22, wherein said multiplier has a first value when at least one of said start-bonus symbols in said spinning reel display does not coincide with said pay line, said multiplier having a second value when all of said start-bonus symbols in said spinning reel display coincide with said pay line.

24. The method of claim 19, wherein said spinning reel display includes a video screen showing video images of said reels.

25. The method of claim 19, wherein said reels are mechanical and said spinning reel display includes a window through which said plurality of symbols on each of said mechanical reels are viewed.

26. The method of claim 19, wherein said bonus game includes a bonus display showing a plurality of symbols on at least one rotatable bonus reel.

27. The method of claim 19, wherein said bonus game includes a bonus display showing a grid of windows hiding bonus game symbols which are revealed upon selection of their respective windows.

28. The method of claim 19, wherein said bonus game includes a bonus display showing a poker hand.

29. The method of claim 19, wherein said bonus game provides first and second different expected values, said bonus game having said first expected value when all of said start-bonus symbols in said spinning reel display coincide with another pay line different from said pay line, said bonus game having said second expected value when all of said start-bonus symbols in said spinning reel display coincide with said pay line.

30. A slot machine, comprising:

a spinning reel display showing a plurality of symbols on each of a plurality of rotatable reels, said reels being rotated and stopped to place said symbols of each reel in visual association with a pay line, said pay line being associated with at least one of said symbols on each of said reels; and a bonus game triggered in response to start-bonus symbols from said respective stopped reels appearing in said spinning reel display, said bonus game having different expected values based on different arrangements of said start-bonus symbols in said spinning reel display, said different arrangements being comprised of the same start-bonus symbols such that said start-bonus symbols in one of said arrangements are the same as the start-bonus symbols in another of said arrangements.

31. The slot machine of claim 30, wherein said start-bonus symbols from said respective stopped reels are identical in appearance.

32. The slot machine of claim 31, wherein said different arrangements of said start-bonus symbols that trigger said bonus game do not generate any payouts in said base game.

33. The slot machine of claim 30, wherein said spinning reel display includes a video screen showing video images of said reels.

* * * * *

UNITED STATES PATENT AND TRADEMARK OFFICE

CERTIFICATE OF CORRECTION

PATENT NO. : 6,234,897 B1
DATED : May 22, 2001
INVENTOR(S) : Frohm et al.

It is certified that error appears in the above-identified patent and that said Letters Patent is hereby corrected as shown below:

Title page,
Item [56], U. S. Patent Documents, delete "5,167,147" and insert -- 5,169,147--.

Title page,
Item [56], Other Publications, third reference (Advertisement, "Happy Clown"), delete "s.p.r." and insert -- s.p.r.l.--.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*